US007710091B2

(12) United States Patent
Huang

(10) Patent No.: US 7,710,091 B2
(45) Date of Patent: May 4, 2010

(54) LOW DROPOUT LINEAR VOLTAGE REGULATOR WITH AN ACTIVE RESISTANCE FOR FREQUENCY COMPENSATION TO IMPROVE STABILITY

(75) Inventor: Wei-Jen Huang, Taipei County (TW)

(73) Assignee: Sitronix Technology Corp., Hsinchu Hsien (TW)

( * ) Notice: Subject to any disclaimer, the term of this patent is extended or adjusted under 35 U.S.C. 154(b) by 320 days.

(21) Appl. No.: 11/819,461

(22) Filed: Jun. 27, 2007

(65) Prior Publication Data

US 2009/0001953 A1 Jan. 1, 2009

(51) Int. Cl.
*G05F 1/575* (2006.01)

(52) U.S. Cl. ..... 323/280; 330/109; 323/277

(58) Field of Classification Search ..... 323/280, 323/273, 277; 330/109, 294, 100, 260, 282
See application file for complete search history.

(56) References Cited

U.S. PATENT DOCUMENTS 6,690,147 B2 * 2/2004 Bonto ..... 323/280
2007/0018621 A1 * 1/2007 Mok et al. ..... 323/280

OTHER PUBLICATIONS

Sai Kit Lau, Ka Nang Leung, Philip Mok, Analysis of Low-Dropout Regulator Topologies for Low-Voltage Regulation, Dec. 16, 2003, Electron Devices and Solid-State Circuits, 2003 Conferences on, pp. 379-382.*

* cited by examiner

*Primary Examiner*—Harry Behm
(74) *Attorney, Agent, or Firm*—Muncy, Geissler, Olds & Lowe, PLLC

(57) ABSTRACT

The present invention discloses an LDO (Low DropOut) linear voltage regulator, which is based on an NMC (Nested Miller Compensation) architecture and can be capacitor-free, wherein an active resistor is added to the feedback path of the Miller compensation capacitor to increase the controllability of the damping factor, solve the problem of extensively using the output capacitor with a parasitic resistance, and solve the problem that a compromise must be made between the damping factor control and the system loop gain. Further, the present invention utilizes a capacitor-sharing technique to reduce the Miller capacitance required by the entire system and accelerate the stabilization of output voltage without influencing stability.

5 Claims, 6 Drawing Sheets

LOW DROPOUT LINEAR VOLTAGE REGULATOR WITH AN ACTIVE RESISTANCE FOR FREQUENCY COMPENSATION TO IMPROVE STABILITY

FIELD OF THE INVENTION

The present invention relates to a low dropout linear voltage regulator, particularly to a low dropout linear voltage regulator adopting an active resistor and a capacitor-sharing technique to realize a capacitor-free feature.

BACKGROUND OF THE INVENTION

Due to the maturity of the communication market, the application of the relevant IC also persistently grows. With the prevalence of portable electronic products, such as mobile phones, battery runtime becomes very important. Thus, how to promote the efficiency and stability of batteries has been a challenge in the related field.

Because of compactness, low noise and high conversion efficiency, the LDO (Low Dropout) linear voltage regulator has been the mainstream of small-power regulators and step-down transformers and has been widely used in portable electronic products and communication-related products.

In the existing products/methods, three stages of amplifiers are usually adopted to increase the gain of an LDO linear voltage regulator and achieve a higher accuracy. However, such an approach is apt to result in the instability of the LDO linear voltage regulator. Therefore, various frequency compensation methods are proposed to stabilize the system. A pole-zero compensation, i.e., adding an external big-size capacitor to lower the dominant pole and increase phase margin, was proposed, wherein a big-size output capacitor is needed to move the dominant pole to low frequency to maintain stability. As the dominant pole is located at the output of LDO linear voltage regulator, the maximum load current will influence the stability. Such a method has the following disadvantages:

1. As the dominant pole is located at the output of LDO linear voltage regulator, such a circuit needs a bigger capacitor to stabilize the system. However, it is hard to integrate on a single chip, which increases difficulty in system-on-chip.
2. Generally speaking, a greater gain, which can promote system accuracy, is expected. However, increasing gain will decrease system stability in such a circuit. Therefore, a compromise must be made between gain and stability.
3. Greater load current means lower load resistance and greater dominant pole. The greater the dominant pole, the poorer the system stability. Thus, system stability limits load current in such a circuit.

Refer to FIG. 1. Someone proposed an LDO linear voltage regulator using nested Miller compensation to solve the abovementioned problems. The LDO linear voltage regulator 10 comprises an input terminal $V_{IN}$ receiving input DC voltage; an output terminal $V_{OUT}$ outputting a stabilized output voltage; a first-stage amplifier 11; a second-stage amplifier 12 cascaded to the first-stage amplifier 11; and a power transistor 13 cascaded to the second-stage amplifier 12. The source of the power transistor 13 is coupled to the input terminal $V_{IN}$, and the drain is coupled to the output terminal $V_{OUT}$, and the gate is coupled to the output terminal of the second-stage amplifier 12. The anti-phase input terminal of the first-stage amplifier 11 receives a reference voltage signal input by a reference voltage generator 14, and the in-phase input terminal is coupled to a node 15, and the output terminal is coupled to the input terminal of the second-stage amplifier 12. A first Miller compensation capacitor $C_{m1}$ is arranged in the feedback path between the output terminal of the first-stage amplifier 11 and the drain of the power transistor 13. A second Miller compensation capacitor $C_{m2}$ is arranged in the feedback path between the output terminal of the second-stage amplifier 12 and the drain of the power transistor 13. A feedback resistor network 20 is arranged between the drain of the power transistor 13 and the in-phase input terminal of the first-stage amplifier 11. The feedback resistor network 20 has two resistors $R_{F1}$ and $R_{F2}$, which form a voltage divider. The node 15 is formed in between resistors $R_{F1}$ and $R_{F2}$, and the in-phase input terminal of the first-stage amplifier 11 is coupled to the node 15. The output terminal $V_{OUT}$ of the LDO linear voltage regulator 10 is coupled to an external output capacitor $C_L$ with a parasitic resistance $R_{ESR}$.

In the LDO linear voltage regulator 10 using nested Miller compensation, the dominant pole is moved to the output of the first-stage amplifier 11 via pole splitting. Such an approach does not need a big-size output capacitor $C_L$. The system can still have superior stability under a zero-capacitance output capacitor $C_L$, which benefits SOC (System-on-Chip) application, reduces circuit board area and decreases external elements.

Refer to FIG. 2 for a small-signal model of the abovementioned system. The small-signal model comprises a gain stage $g_{m1}V_s$ of the first-stage amplifier 11, a gain stage $g_{m2}V_2$ of the second-stage amplifier 12, and an output stage of the power transistor 13, and the resistors $R_{F1}$ and $R_{F2}$ form the feedback resistor network 20. $g_{m1}$, $g_{m2}$, $g_{mp}$ are respectively the transductions of the first-stage amplifier 11, the second-stage amplifier 12 and the output stage. $R_{O1}$ and $R_{O2}$ are respectively the output impedances of the first-stage amplifier 11 and the second-stage amplifier 12. $C_{P1}$ and $C_{P2}$ are respectively the parasitic capacitances of the first-stage amplifier 11 and the second-stage amplifier 12. $C_{OUT}$ is the output capacitance, and $R_{ESR}$ is the parasitic resistance of the output capacitor. $C_{m1}$ and $C_{m2}$ are respectively the first and second Miller compensation capacitances. $R_{OUT}(=R_L\|R_{Op}\|(R_{F1}+R_{F1}))$ is the equivalent output resistance, wherein $R_L$ is the load resistance, and $R_{Op}$ is the output resistance of the power PMOS transistor.

From the small-signal model in FIG. 2, the system transformation equation is obtained:

$$L(s) = \frac{A_0\left(1 - s\frac{C_{m2}}{g_{mp}} - s^2\frac{C_{m1}C_{m2}}{g_{m2}g_{mp}}\right)\left(1 + \frac{s}{C_{OUT}R_{ESR}}\right)}{\left(1 + \frac{s}{p_{-3dB}}\right)\left[1 + s\left(C_{OUT}R_{ESR} + \frac{C_{m2}}{g_{m2}}\right) + s^2\left(\frac{C_{m2}C_{OUT}}{g_{m2}g_{mp}}\right)\right]} \quad (1)$$

wherein the DC loop gain is given by $$A_0 = g_{m1}g_{m2}g_{mp}R_{O1}R_{O2}R_{OUT}\left(\frac{R_{F2}}{R_{F1} + R_{F2}}\right), \quad (2)$$

and the dominant pole $$p_{-3\ \mathrm{dB}} = \frac{1}{C_{m1} g_{m2} g_{mp} R_{O1} R_{O2} R_{OUT}} \tag{3}$$

The damping factor can thus be worked out:

$$\zeta = \frac{1}{2}\left(C_{OUT} R_{ESR} + \frac{C_{m2}}{g_{m2}}\right)\sqrt{\frac{g_{m2} g_{mp}}{C_{m2} C_{OUT}}} \tag{4}$$

From the abovementioned equations, it is known: the damping factor $\zeta$ varies with the output capacitance $C_{OUT}$ and the parasitic resistance $R_{ESR}$ of the output capacitor. When the output capacitance $C_{OUT}$ and the parasitic resistance $R_{ESR}$ are very small, the second-stage transduction $g_{m2}$ must be reduced so as to obtain a sufficiently high damping factor $\zeta$ and use a smaller Miller compensation capacitance $C_{m2}$. However, the system feedback gain will become smaller, and the system accuracy is decreased. Thus, a compromise must be made between the damping factor $\zeta$ and the system loop gain.

SUMMARY OF THE INVENTION

The primary objective of the present invention is to utilize nested Miller compensation and pole-splitting to move the dominant pole to the output of a first-stage amplifier. Such an approach does not need a big-size output capacitor, and the system can still have superior stability even under a zero-capacitance output capacitor. An active resistor is arranged in the feedback path of a Miller capacitor to increase the controllability of the damping factor, solve the problem of extensively using the output capacitor with a parasitic resistance, and solve the problem that a compromise must be made between the damping factor control and the system loop gain.

Another objective of the present invention is to utilize a capacitor-sharing technique to reduce the Miller capacitance of the entire system. Thus, the bandwidth can be extended, and the voltage stabilization can be accelerated.

The present invention proposes a low dropout (LDO) linear voltage regulator, which comprises an input terminal receiving input DC voltage; an output terminal outputting a stabilized output voltage; a power transistor, wherein the source thereof is coupled to the input terminal, and the drain thereof is coupled to the output terminal; a first-stage amplifier, wherein the anti-phase input terminal of the first-stage amplifier receives a reference voltage signal input by a reference voltage generator, and the in-phase input terminal is coupled to a node, and a first Miller compensation capacitor is arranged in between the output terminal of the first-stage amplifier and the drain of the power transistor; a second-stage amplifier, wherein the input terminal of the second-stage amplifier is coupled to the output terminal of the first-stage amplifier, and a second Miller compensation capacitor and an active resistor cascaded to the second Miller compensation capacitor are arranged in between the output terminal of the second-stage amplifier and the drain of the power transistor; and a feedback resistor network arranged in between the drain of the power transistor and the in-phase input terminal of the first-stage amplifier, wherein the feedback resistor network has two resistors, which form a voltage divider, and a node is formed in between the two resistors. Transistors are connected to form a diode functioning as the active resistor.

Based on nested Miller compensation, the present invention utilizes pole-splitting to move the dominant pole to the output of a first-stage amplifier. Thereby, the system does not need a big-size output capacitor, and the system can still have superior stability even under a zero-capacitance output capacitor, which benefits SOC (System-on-Chip) application, reduces circuit board area and decreases external elements. An insufficient damping factor will result in that frequency response has a surge appearing in the near-by of unit-gain frequency, and that the step response of the output voltage to the load current has ripples in the quasi-linear region; thus, the stabilization is decelerated. The damping factor varies with the output capacitance and the parasitic resistance of the output capacitor. Therefore, the present invention adds an active resistor to the feedback path of the Miller capacitor to increase the controllability of the damping factor, solve the problem of extensively using the output capacitor with a parasitic resistance, and solve the problem that a compromise must be made between the damping factor control and the system loop gain.

The LDO linear voltage regulator of the present invention further comprises a capacitor-sharing circuit. The capacitor-sharing circuit includes a shared capacitor. The capacitor-sharing circuit detects the current of the power transistor and switches the shared capacitor to connect in parallel with the first Miller compensation capacitor or the second Miller compensation capacitor. Thereby, the Miller capacitance required by the entire system is reduced, and the stabilization of output voltage is accelerated.

The capacitor-sharing circuit also includes: a current-detection circuit used to detect the current of the power transistor; a Schmitt trigger circuit receiving a signal from the current-detection circuit and transmitting the signal to a non-overlapping clock generator to create two non-overlapping clock signals; a first switch and a second switch respectively controlled by the abovementioned two clock signals, wherein the first switch is arranged in between the first Miller compensation capacitor and the shared capacitor, and the second switch is arranged in between the second Miller compensation capacitor and the shared capacitor.

When the power transistor operates in the triode region, the shared capacitor is switched to connect in parallel with the first Miller compensation capacitor to create a greater Miller compensation capacitance to move the dominant pole to low frequency. In other words, when the load is light, the power transistor operates in the triode region, and the shared capacitor is switched to connect in parallel with the first Miller compensation capacitor to create a greater Miller compensation capacitance to move the dominant pole to low frequency so that the system can has a sufficient phase-angle margin.

When the power transistor operates in the saturation region, the shared capacitor is switched to connect in parallel with the second Miller compensation capacitor to create a greater Miller compensation capacitance to enhance the controllability of the damping factor. In other words, when the load current persistently increases and the power transistor operates in the saturation region, the shared capacitor is switched to connect in parallel with the second Miller compensation capacitor to create a greater Miller compensation capacitance to enhance the controllability of the damping factor. As there is smaller capacitance in the feedback path of the first Miller compensation capacitor at this time, the bandwidth can be extended when the load is heavy.

DETAILED DESCRIPTION OF THE PREFERRED EMBODIMENTS

Below, the technical contents of the present invention are described in detail with the embodiments. It is to be noted that the embodiments are only to exemplify the present invention but not to limit the scope of the present invention.

Figure 1:
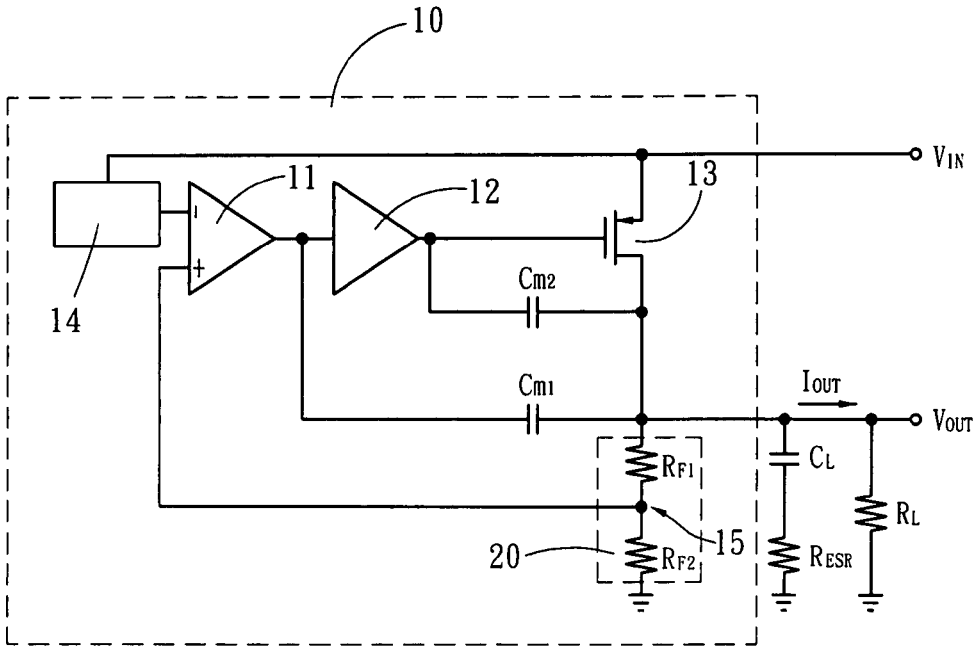
Fig. 1 PRIOR ART
FIG. 1 is a diagram schematically showing an LDO linear voltage regulator using nested Miller compensation.
Figure 2:
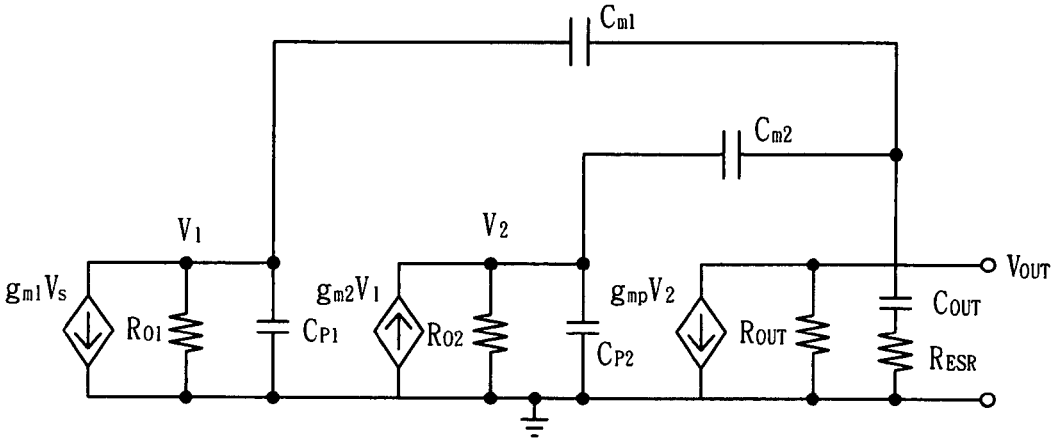
Fig. 2 PRIOR ART
FIG. 2 is a diagram showing a small-signal model of the circuit shown in FIG. 1.
Figure 3:
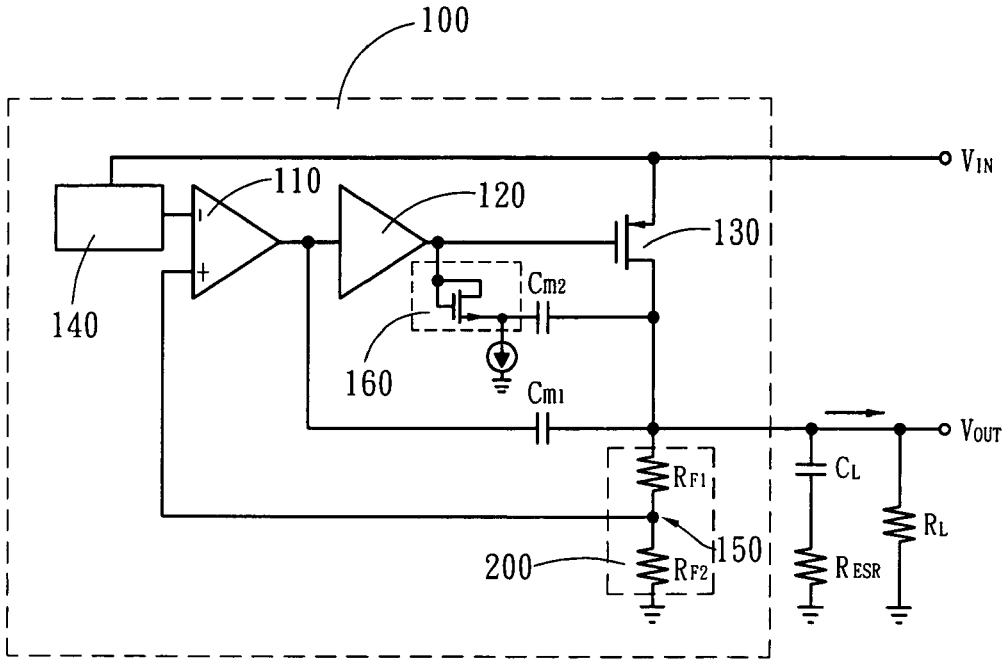
FIG. 3 is a diagram schematically showing that an LDO linear voltage regulator with an active resistor added to the feedback path of a Miller compensation capacitor according to the present invention.

Refer to FIG. 3 a diagram schematically showing that an active resistor is added to the feedback path of the Miller compensation capacitor. Based on the nested Miller compensation architecture, the low dropout (LDO) linear voltage regulator 100 of the present invention comprises: an input terminal $V_{IN}$ receiving input DC voltage; an output terminal $V_{OUT}$ outputting a stabilized output voltage; a first-stage amplifier 110; a second-stage amplifier 120 cascaded to the first-stage amplifier 110; and a power transistor 130 cascaded to the second-stage amplifier 120. The source of the power transistor 130 is coupled to the input terminal $V_{IN}$, and the drain is coupled to the output terminal $V_{OUT}$, and the gate is coupled to the output terminal of the second-stage amplifier 120. The anti-phase input terminal of the first-stage amplifier 110 receives a reference voltage signal input by a reference voltage generator 140, and the in-phase input terminal is coupled to a node 150, and the output terminal is coupled to the input terminal of the second-stage amplifier 120. A first Miller compensation capacitor $C_{m1}$ is arranged in the feedback path between the output terminal of the first-stage amplifier 110 and the drain of the power transistor 130. A second Miller compensation capacitor $C_{m2}$ is arranged in the feedback path between the output terminal of the second-stage amplifier 120 and the drain of the power transistor 130. A feedback resistor network 200 is arranged between the drain of the power transistor 130 and the in-phase input terminal of the first-stage amplifier 110. The feedback resistor network 200 has two resistors $R_{F1}$ and $R_{F2}$, which form a voltage divider. The node 150 is formed in between resistors $R_{F1}$ and $R_{F2}$, and the in-phase input terminal of the first-stage amplifier 110 is coupled to the node 150. The output terminal $V_{OUT}$ of the LDO linear voltage regulator 100 is coupled to an external output capacitor $C_L$ with a parasitic resistance $R_{ESR}$.

The present invention is characterized in that an active resistor 160 is cascaded to the second Miller compensation capacitor $C_{m2}$ in the feedback path between the output terminal of the second-stage amplifier 120 and the drain of the power transistor 130 to increase the controllability of the damping factor ζ, solve the problem of extensively using the output capacitor $C_L$ with a parasitic resistance $R_{ESR}$, and solve the problem that a compromise must be made between the damping factor control and the system loop gain. Transistors are connected to form a diode functioning as the active resistor 160.

From Equations (1), (2), (3) and (4), it is known: the damping factor ζ varies with the output capacitance $C_{OUT}$ and the parasitic resistance $R_{ESR}$ of the output capacitor. When the output capacitance $C_{OUT}$ and the parasitic resistance $R_{ESR}$ are very small, the second-stage transduction $g_{m2}$ must be reduced so as to obtain a sufficiently high damping factor ζ and use a smaller Miller compensation capacitance $C_{m2}$. However, the system feedback gain will become smaller, and the system accuracy is decreased. Thus, a compromise must be made between the damping factor ζ and the system loop gain.

Figure 4:
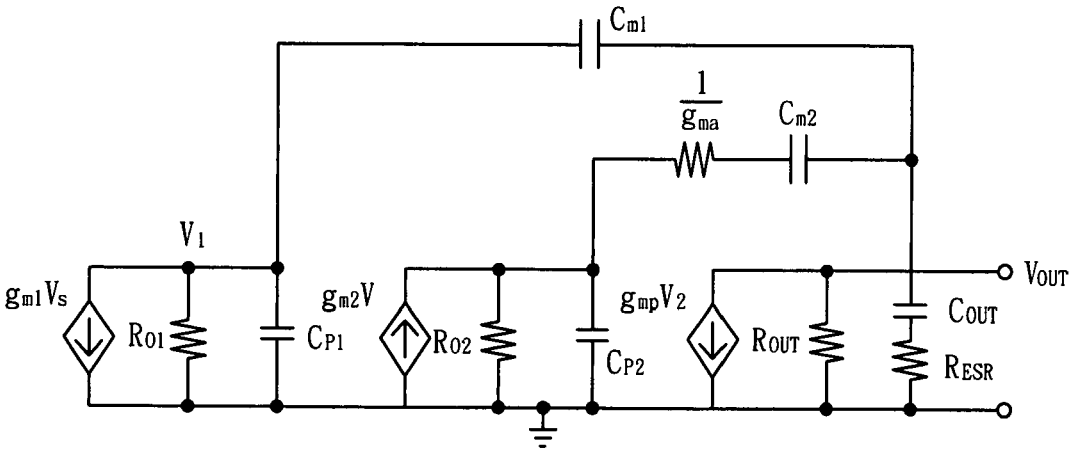
FIG. 4 is a diagram showing a small-signal model of the circuit shown in FIG. 3.

Therefore, the present invention adds the active resistor 160 to the feedback path of the related Miller compensation capacitor. Refer to FIG. 4 for a small-signal model for the system of the present invention. The small-signal model comprises a gain stage $g_{m1}V_s$ of the first-stage amplifier 110, a gain stage $g_{m2}V_2$ of the second-stage amplifier 120, and an output stage of the power transistor 130, and the resistors $R_{F1}$ and $R_{F2}$ form the feedback resistor network 200. $g_{m1}$, $g_{m2}$, $g_{ma}$, $g_{mp}$ are respectively the transductions of the first-stage amplifier 110, the second-stage amplifier 120, the active resistor 160 and the output stage. $R_{O1}$ and $R_{O2}$ are respectively the output impedances of the first-stage amplifier 110 and the second-stage 10 amplifier 120. $C_{P1}$ and $C_{P2}$ are respectively the parasitic capacitances of the first-stage amplifier 110 and the second-stage amplifier 120. $C_{OUT}$ is the output capacitance, and $R_{ESR}$ is the parasitic resistance of the output capacitor. $C_{m1}$ and $C_{m2}$ are respectively the first and second Miller compensation capacitances. $R_{OUT}$ ($=R_L \| R_{Op} \| (R_{F1}+R_{F1})$) is the equivalent output resistance, wherein $R_L$ is the load resistance, and $R_{Op}$ is the output resistance of the power transistor.

From the small-signal model in FIG. 4, the system transformation equation is expressed as:

$$L(s) = \frac{A_0\left(1 + s\frac{C_{m2}}{g_{ma}} - s^2\frac{C_{m1}C_{m2}}{g_{m2}g_{mp}}\right)\left(1 + \frac{s}{C_{OUT}R_{ESR}}\right)}{\left(1 + \frac{s}{p_{-3\,\mathrm{dB}}}\right)\left[1 + s\left(C_{OUT}R_{ESR} + \frac{C_{m2}}{g_{m2}} + \frac{C_{m2}}{g_{ma}}\right) + s^2\left(\frac{C_{m2}C_{OUT}}{g_{m2}g_{mp}}\right)\right]} \tag{5}$$

The damping factor can be derived as:

$$\zeta = \frac{1}{2}\left(C_{OUT}R_{ESR} + \frac{C_{m2}}{g_{m2}} + \frac{C_{m2}}{g_{ma}}\right)\sqrt{\frac{g_{m2}g_{mp}}{C_{m2}C_{OUT}}} \tag{6}$$

Thus, the transduction $g_{ma}$ of the active resistor 160 is designed to be very small to enhance the controllability of the damping factor ζ. Then, the transduction $g_{m2}$ of the second-stage amplifier 120 needn't change. Thus, the system feedback gain will not be affected, and the system accuracy will not decrease.

Figure 5:
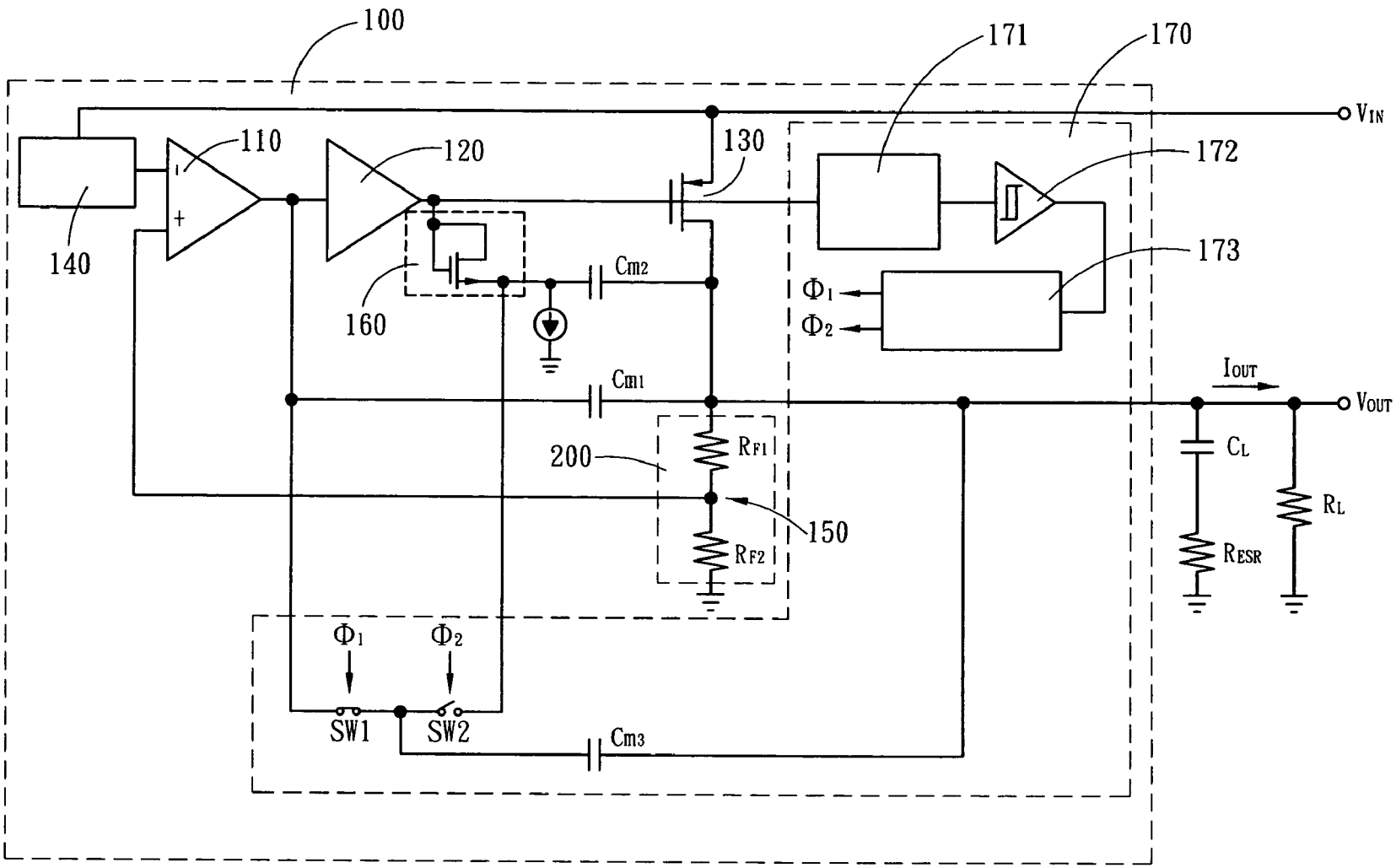
FIG. 5 is a diagram schematically showing that a capacitor-sharing circuit is added to the circuit shown in FIG. 3 according to the present invention.
Figure 6A:
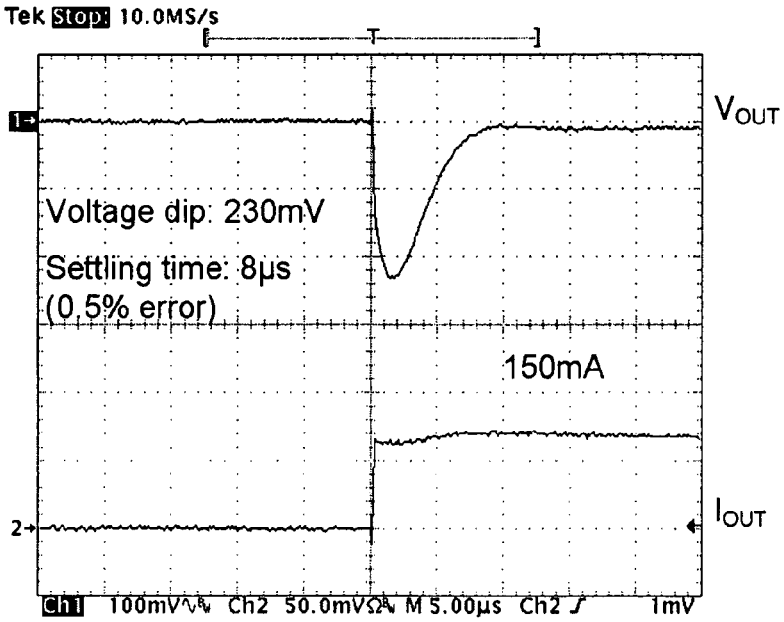
FIG. 6A to FIG. 6C are diagrams showing the test results for the circuit shown in FIG. 3, which does not use a capacitor-sharing technique.
Figure 6B:
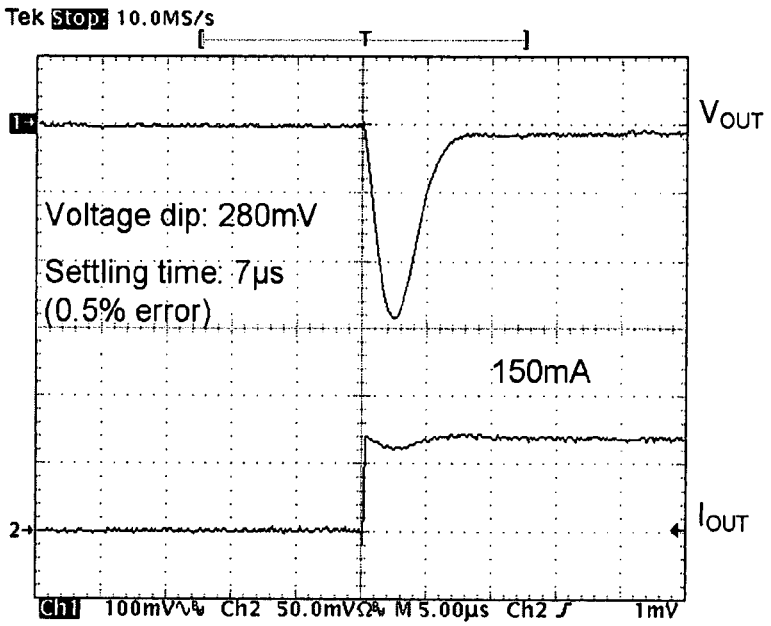
Figure 6C:
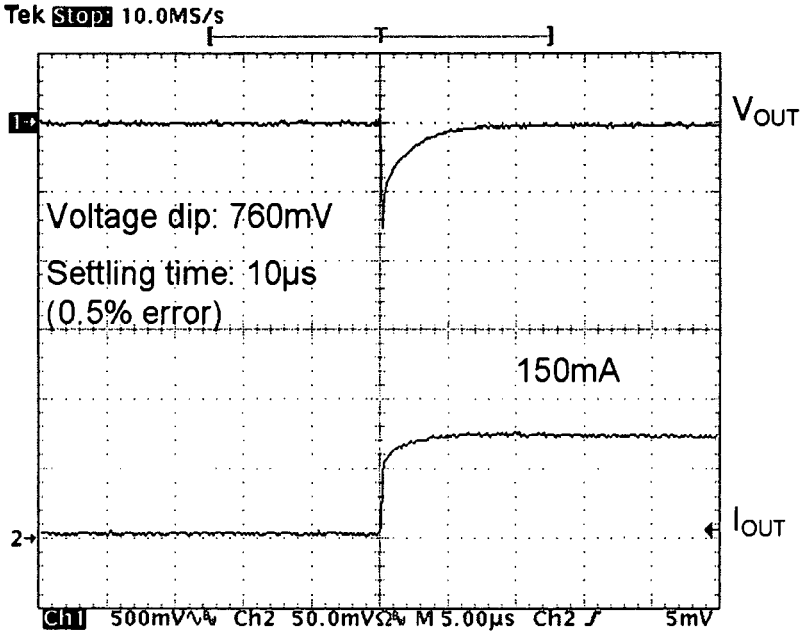
Figure 7A:
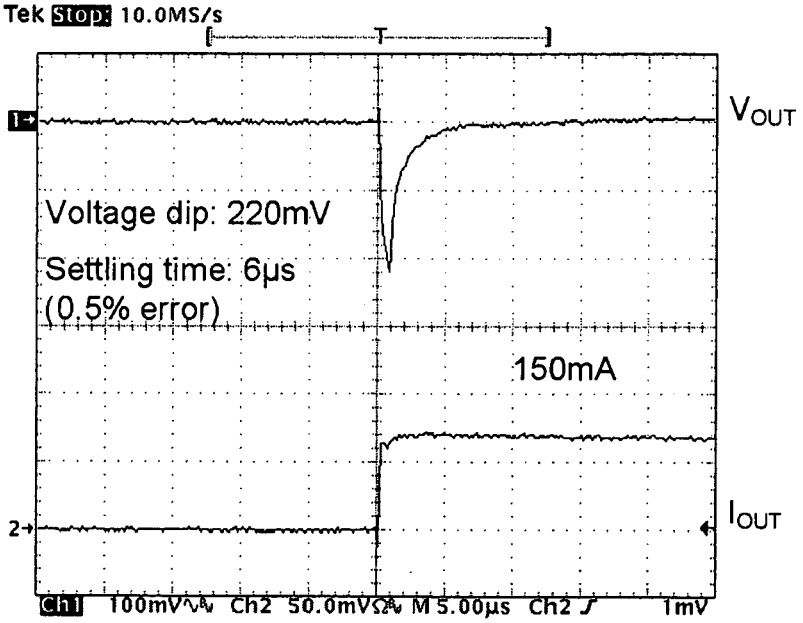
FIG. 7A to FIG. 7C are diagrams showing the test results for the circuit shown in FIG. 5, which uses a capacitor-sharing technique.
Figure 7B:
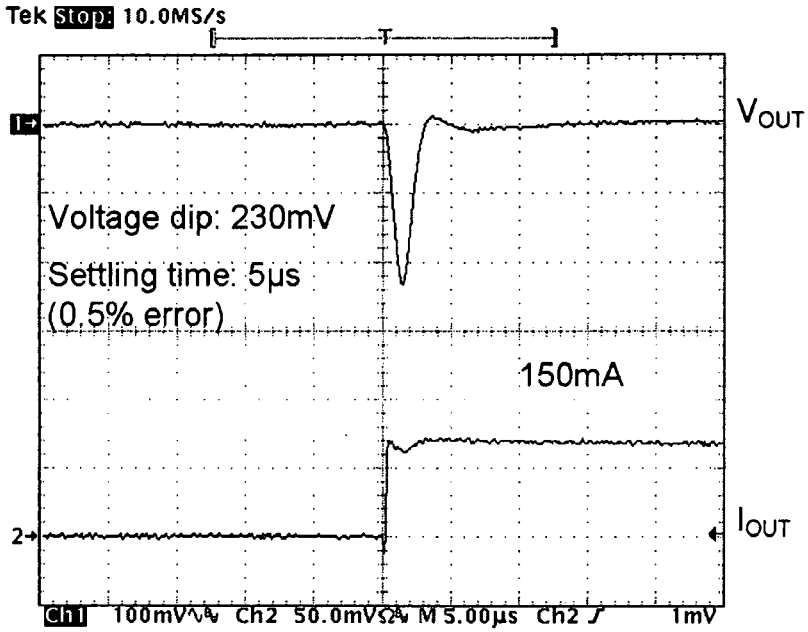
Figure 7C:
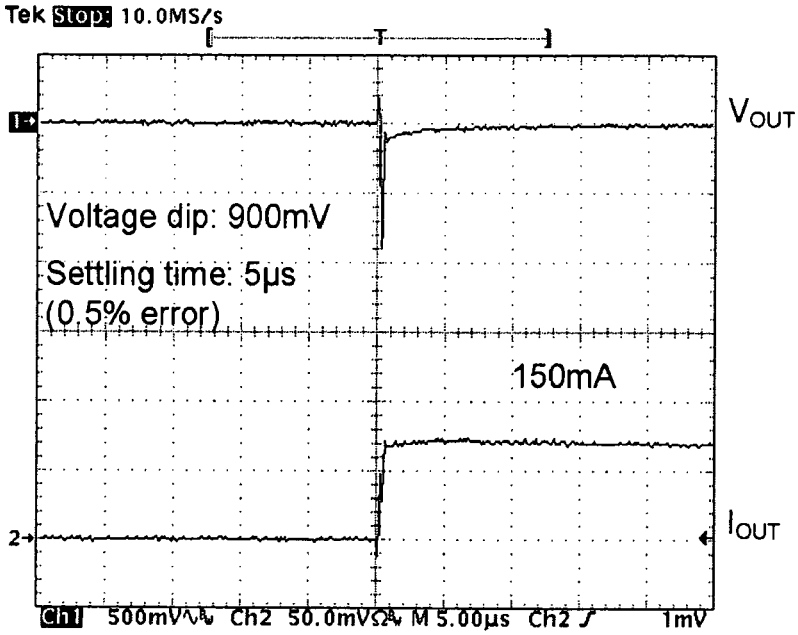

Refer to FIG. 5. The present invention further proposes a capacitor-sharing technique to greatly reduce the Miller compensation capacitance. Based on the consideration of stability, when the load is light, a greater first Miller compensation capacitance $C_{m1}$ is needed to move the dominant pole to low frequency and make the system have sufficient phase-angle margin. When the load is heavy, a greater second Miller compensation capacitance $C_{m2}$ is needed to enhance the controllability of the damping factor $\zeta$. Therefore, the states of a light load and a heavy load respectively have different requirements to the first and second Miller compensation capacitances $C_{m1}$ and $C_{m2}$. Thus, the present invention further provides a capacitor-sharing circuit 170. The capacitor-sharing circuit 170 detects the current of the power transistor 130 and switches a shared capacitor $C_{m3}$ to connect in parallel with the first Miller compensation capacitor $C_{m1}$ or the second Miller compensation capacitor $C_{m2}$ in response to different loads. Thereby, the Miller capacitance required by the entire system is reduced. As the entire capacitance is reduced, the bandwidth is extended, and the stabilization of output voltage is accelerated.

In the capacitor-sharing technique, a current sensing circuit 171 detects the current of the power transistor 130, and the result is used to drive a Schmitt trigger circuit 172 and a non-overlapping clock generator 173. The hysteresis of the Schmitt trigger circuit 172 can prevent from the noise occurring during switching and can accelerate transient response. The non-overlapping clock generator 173 can prevent from the overlapping of the created clocks $\Phi_1$ and $\Phi_2$ lest a first switch SW1 and a second switch SW2 operate simultaneously, wherein the first switch SW1 is arranged in between the first Miller compensation capacitor $C_{m1}$ and the shared capacitor $C_{m3}$, and the second switch SW2 is arranged in between the second Miller capacitor $C_{m2}$ and the shared capacitor $C_{m3}$.

When the load is light, the power transistor 130 operates in the triode region, the clock $\Phi_1$ is at the high-level potential, and the first switch SW1 turns on (The clock $\Phi_2$ is at the low-level potential, and the second switch SW2 turns off.). Thus, the shared capacitor $C_{m3}$ is switched to connect in parallel with the first Miller compensation capacitor $C_{m1}$ to create a greater Miller compensation capacitance to move the dominant pole to low frequency so that the system can has a sufficient phase-angle margin.

When the load current persistently increases and the power transistor operates in the saturation region, the clock $\Phi_1$ is at the low-level potential, and the first switch SW1 turns off (The clock $\Phi_2$ is at the high-level potential, and the second switch SW2 turns on.). Thus, the shared capacitor $C_{m3}$ is switched to connect in parallel with the second Miller compensation capacitor $C_{m2}$ to create a greater Miller compensation capacitance to enhance the controllability of the damping factor $\zeta$. As there is smaller capacitance in the feedback path of the first Miller compensation capacitor $C_{m1}$ at this time, the bandwidth can be extended when the load is heavy.

The present invention meets stability requirements of different loads via connecting the shared capacitor $C_{m3}$ in parallel with the first Miller compensation capacitor $C_{m1}$ or the second Miller compensation capacitor $C_{m2}$ to reduce the required capacitance required by the entire system, which can further extends the bandwidth and accelerate the stabilization of output voltage. It is proved by tests that the Miller capacitance required by the entire system can be reduced 40% without influencing stability.

Refer to FIGS. 6A-6C and FIGS. 7A-7C respectively diagrams showing the test results of the cases not using and using the capacitor-sharing technique. The tests adopt identical test environment: (1) $C_{OUT}$=1 μF and $R_{ESR}$=1Ω, (2) $C_{OUT}$=1 μF and $R_{ESR}$ =0.3Ω, (3) $C_{OUT}$=0. In the cases not using the capacitor-sharing technique, the time to reach stability is 8 μsec in FIG. 6A, 7 μsec in FIG. 6B, and 10 μsec in FIG. 6C. In the cases using the capacitor-sharing technique, the time to reach stability is 6 μsec in FIG. 7A, 5 μsec in FIG. 7B, and 5 μsec in FIG. 7C. From the test results, it is known: the capacitor-sharing technique not only reduces the Miller capacitance required by the entire system but also accelerates the stabilization of output voltage without influencing stability.

Those described above are only the preferred embodiments to exemplify the present invention but not to limit the scope of the present invention. Any equivalent modification or variation according to the spirit of the present invention is to be also included within scope of the present invention.

What is claimed is:

1. A low dropout linear voltage regulator comprising:

an input terminal receiving input DC voltage and an output terminal outputting a stabilized output voltage;

a power transistor, wherein the source of said power transistor is coupled to said input terminal, and the drain of said power transistor is coupled to said output terminal;

a first-stage amplifier, wherein the anti-phase input terminal of said first-stage amplifier receives a reference voltage signal input by a reference voltage generator, and the in-phase input terminal of said first-stage amplifier is coupled to a node, and a first Miller compensation capacitor is arranged in between the output terminal of said first-stage amplifier and the drain of said power transistor;

a second-stage amplifier, wherein the input terminal of said second-stage amplifier is coupled to the output terminal of said first-stage amplifier, and a second Miller compensation capacitor and an active resistor cascaded to said second Miller compensation capacitor are arranged in between the output terminal of the second-stage amplifier and the drain of the power transistor;

a feedback resistor network arranged in between the drain of said power transistor and the in-phase input terminal of said first-stage amplifier, wherein said feedback resistor network has two resistors, which form a voltage divider, and said node is formed in between said resistors;

a capacitor-sharing circuit, wherein said capacitor-sharing circuit includes a shared capacitor, and said capacitor-sharing circuit detects the current of said power transistor and switches said shared capacitor to connect in parallel with said first Miller compensation capacitor or said second Miller compensation capacitor.

2. The low dropout linear voltage regulator according to claim 1, wherein transistors are connected to form a diode functioning as said active resistor.

3. The low dropout linear voltage regulator according to claim 1, wherein said capacitor-sharing circuit further comprises:

a current sensing circuit detecting the current of said power transistor;

a Schmitt trigger circuit receiving a signal from said current sensing circuit and transmitting said signal to a non-overlapping clock generator to create two non-overlapping clocks; and a first switch and a second switch respectively controlled by said two non-overlapping clocks, wherein said first switch is arranged in between said first Miller compensation capacitor and said shared capacitor, and said second switch is arranged in between said second Miller capacitor and said shared capacitor.

4. The low dropout linear voltage regulator according to claim 1, wherein when said power transistor operates in a triode region, said shared capacitor is switched to connect in parallel with said first Miller compensation capacitor to create a greater Miller compensation capacitance to move the dominant pole to low frequency.

5. The low dropout linear voltage regulator according to claim 1, wherein when said power transistor operates in a saturation region, said shared capacitor is switched to connect in parallel with said second Miller compensation capacitor to create a greater Miller compensation capacitance to enhance the controllability of the damping factor.

* * * * *